US008657115B2

(12) United States Patent
Roempp et al.

(10) Patent No.: US 8,657,115 B2
(45) Date of Patent: Feb. 25, 2014

(54) ARRANGEMENT OF A PLURALITY OF MOISTENED COSMETIC PADS AND METHOD FOR THE PRODUCTION THEREOF

(75) Inventors: Angela Roempp, Duemau (DE); Jana Michelmann, Weimar (DE); Rainer Mangold, Herbrechtingen (DE)

(73) Assignee: Paul Hartmann AG (DE)

( * ) Notice: Subject to any disclaimer, the term of this patent is extended or adjusted under 35 U.S.C. 154(b) by 1286 days.

(21) Appl. No.: 11/814,756

(22) PCT Filed: Jan. 10, 2006

(86) PCT No.: PCT/EP2006/000124

§ 371 (c)(1),
(2), (4) Date: Jul. 16, 2009

(87) PCT Pub. No.: WO2006/079446

PCT Pub. Date: Aug. 3, 2006

(65) Prior Publication Data

US 2011/0094919 A1 Apr. 28, 2011

(30) Foreign Application Priority Data

Jan. 25, 2005 (DE) ..... 10 2005 004 342

(51) Int. Cl.
*B65D 73/00* (2006.01)

(52) U.S. Cl.
USPC ..... 206/494; 206/210; 442/153; 442/164; 442/361; 442/391; 442/416; 53/431; 53/438; 53/447

(58) Field of Classification Search
USPC ..... 206/210, 205, 494, 440, 207, 581, 823; 442/153, 164, 165, 344, 361–364, 381, 442/391, 416; 53/431, 438, 447
See application file for complete search history.

(56) References Cited

U.S. PATENT DOCUMENTS 3,965,519 A * 6/1976 Hermann ..... 15/104.93
4,408,437 A 10/1983 Crouch et al.

(Continued)

FOREIGN PATENT DOCUMENTS

DE 202004007851 9/2004
EP 0256950 3/1993
WO 00/56201 A1 9/2000

OTHER PUBLICATIONS

Written opinion of the International Search Authority dated Jul. 31, 2007.

(Continued)

*Primary Examiner* — Jacob K Ackun
*Assistant Examiner* — Jenine Pagan
(74) *Attorney, Agent, or Firm* — Young Basile Hanlon & MacFarlane, P.C.

(57) ABSTRACT

An arrangement having a plurality of moistened cosmetic pads based on nonwovens which are piled into a closable packaging container in order to distribute to the final consumer and to prevent evaporation. The pads have, on average, a moisture content of at least 200% of the dry weight thereof in the arrangement, the pads have a fiber structure made of staple fibers, are individually moistened and have a homogeneous moisture content such that the difference of the average moisture content of the pads which are arranged in the upper and in the lower quarter of the stack is, at a maximum, 30% of the average moisture content of all of the pads.

45 Claims, 1 Drawing Sheet

(56) References Cited

U.S. PATENT DOCUMENTS

| | | | | |
|---|---|---|---|---|
| 4,649,695 | A | 3/1987 | Crouch et al. | |
| 4,775,582 | A | 10/1988 | Abba et al. | |
| 4,833,033 | A | 5/1989 | Sannohe et al. | |
| 4,853,281 | A | 8/1989 | Win et al. | |
| 5,540,332 | A * | 7/1996 | Kopacz et al. | 206/494 |
| 6,030,331 | A * | 2/2000 | Zander | 493/356 |
| 6,196,390 | B1 * | 3/2001 | Bando | 206/494 |
| 6,213,344 | B1 * | 4/2001 | Hill | 221/38 |
| 6,315,114 | B1 | 11/2001 | Keck et al. | |
| 6,550,634 | B1 * | 4/2003 | Alegre De Miquel et al. | 221/48 |
| 6,649,262 | B2 * | 11/2003 | Hoo et al. | 428/364 |
| 6,971,542 | B2 * | 12/2005 | Vogel et al. | 221/45 |
| 2004/0245139 | A1 | 12/2004 | Mangold et al. | |
| 2005/0040179 | A1 * | 2/2005 | Lange et al. | 221/100 |
| 2007/0273069 | A1 * | 11/2007 | Brennan et al. | 264/570 |

OTHER PUBLICATIONS

International Search Report dated Mar. 20, 2006.
Examination opinion for PCT/EP2006/000124 dated Mar. 20, 2006.

* cited by examiner

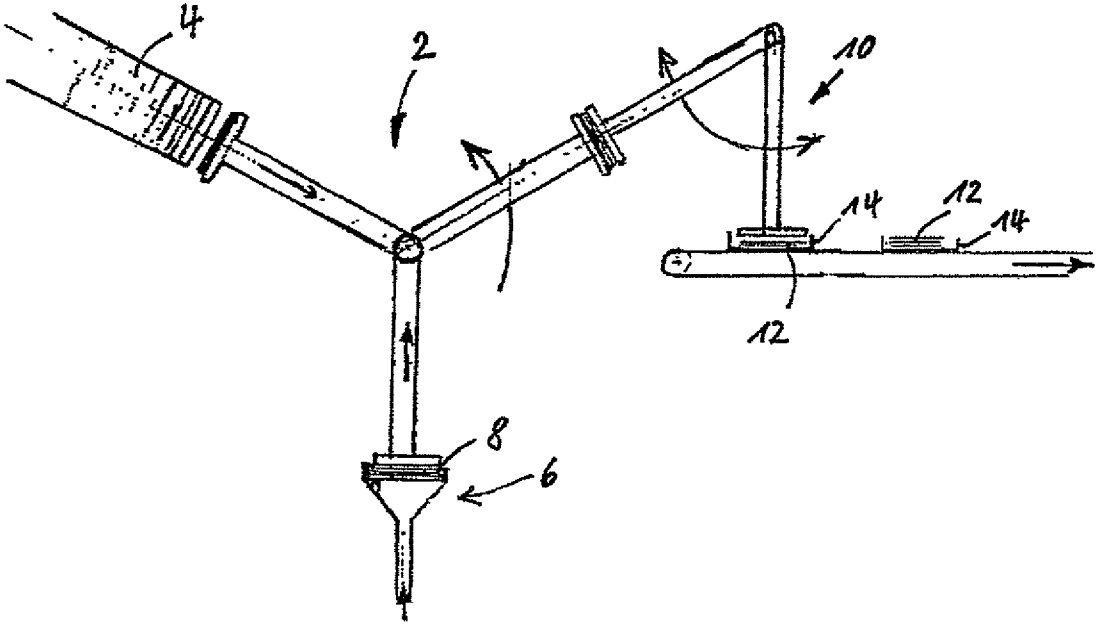
10
14
12
14
12
2
4
8
6

ARRANGEMENT OF A PLURALITY OF MOISTENED COSMETIC PADS AND METHOD FOR THE PRODUCTION THEREOF

BACKGROUND

The present invention relates to an arrangement of moistened cosmetic pads which are stacked in a packaging container for dispensing to the end consumer From U.S. Pat. No. 4,775,582 and EP Patent No. 0 256 950 B1, which is identical in content, and U.S. Pat. Nos. 4,833,033 and 4,853,281 which proceeded from them, moist cloths from melt-blown polyolefin fibers are known. These publications mention a certain uniformity in the moisture content of the moist pads. The use of natural cellulose fibers is expressly presented as disadvantageous and in its place the production of a non-woven from endless melt-blown fibers is disclosed.

Through the manufacturing process of melt-blown fiber layers in which the endless extruded fiber strands are stretched under the effects of hot air and are laid over each other in a not yet solidified condition and are thus joined to each other at the points of contact, a structurally stable construct can be achieved with a pore size of 20 to 60 μm where the fluid from the moist pads can be stored permanently. However, such a structure was not adequate for the demands made on moist cosmetic pads.

U.S. Pat. No. 6,315,114 B1 similarly discloses a stacked arrangement of moist towels in an evaporation-inhibiting closeable packaging container where the pads are spunbond, meaning non-wovens of endless fibers with a diameter of less than 18 μm. In the case of these relatively thin spunbond moist towels, in addition to a consistent moisture content, improved tear resistance and durability against fraying was supposed to have been achieved. For moistening, a stacked arrangement as a whole is exposed to a quantity of fluid. Even these moist towels would not meet the requirement set for moist cosmetic pads.

U.S. Pat. No. 4,408,437 and U.S. Pat. No. 4,649,695 derived from it, relate to a production method and a production device for the conventional moistening of an endless tissue web, meaning a wet laid fiber non-woven structure such as is used for moist towels for personal care. Longitudinal sections are cut from this web and stacked in a packaging container. These patents proceed from a prior art according to which inherently structurally stable wet-laid tissue webs are taken endlessly through a fluid bath. Additional directions cannot be found in these patents.

It would be desirable to create an arrangement of cosmetic pads on a non-woven base which set themselves apart due to their good fluid absorbency and good lasting moisture and fluid retention capability, while attaining a long-lasting consistent wetting of the pads within the stacked arrangement.

SUMMARY

In the arrangement the pads have a fiber structure of staple fibers and are individually moistened and within the arrangement have a consistent moisture content such that the difference in the average moisture content of the pads located in the upper fourth and in the lower fourth of the stack is at most 30% of the average moisture content of all of the pads in the stack.

A method is disclosed for producing an arrangement of a plurality of moistened cosmetic pads in which an air-layered fiber web is formed, the pads are formed from this fiber web and the pads are then individually moistened.

The pads may be exposed to the effects of pressure when still in their individualized state immediately after or during the moistening so that the pads are compressed in order to equalize the distribution of fluid in the pad.

BRIEF DESCRIPTION OF THE DRAWING

Additional features, details and advantages of the invention can be found in the graphic and subsequent description of a in which the drawing shows in FIG. 1 a schematic representation of a device for individually moistening cosmetic pads and to form stacks of these pads.

DETAILED DESCRIPTION

Melt-blown fiber non-wovens or spunbond fiber non-wovens are not used in the pads, but instead an air-laid fiber structure of staple fibers, fibers of a specific finite length or a range of lengths. It has been shown that fiber structures from staple fibers, which can subsume chemical fibers with a specified range of length as well as natural fibers with a length determined by nature, in conjunction with individual moistening of the particular pad, in the course of which a specific amount of fluid is administered to each individual pad, can be used to produce an arrangement of pads which are capable, on one hand permanently and consistently of absorbing and retaining a considerable quantity, but not an excessive quantity of fluid.

The arrangement of a plurality of moistened cosmetic pads on a non-woven basis shows a difference in the average moisture content of the pads in the upper and in the lower fourth of the pads in the stack of at most 28%, specifically at most 20% and further in particular at most 15% at the most, with reference to the average moisture content of all pads in the stack.

The quantity of fluid can also have at least 250%, specifically at least 300%, and, in particular, at least 320% of its dry weight wherein it amounts to at most 500%, in particular at most 450%, and further, in particular, at most 400% of the dry weight of a particular pad. In this context if, when determining the dry weight, statistical methods are applied to the moisture content of a predetermined number of pads, in particular, of all pad and from this the average is created.

By individually moistening the pads, a precisely allocated quantity of fluid is introduced into a particular pad before the stack is formed and the pads are arranged in a packaging container. In contrast to moistening a stack, this brings the quite substantial advantage that independently of the arrangement, and the handling and storage of the filled packaging containers, a consistently predetermined moisture content is achieved in the individual pads. It has also been shown that the tendency for the fluid in the stacked arrangement to follow gravity and settle on the bottom of the packaging container, in particular, in the case of cotton pads with a considerable but not excessive moisture content, can be overcome almost completely. The use of staple fibers makes an advantageous contribution here.

It is proposed to take into consideration the pads located in an upper fourth of the stack and the pads located in a lower fourth of the stack (or expressed differently: the pads located in the outer fourth, the fourth allocated to the particular end of the stack) to the effect that the average moisture content will be determined in these pads. The difference in the average value of the moisture content of these pads from the upper and lower fourths (or from the two outer fourths) deviates in the arrangement in accordance with the invention at the most 30%, specifically 25%, further in particular a maximum 20%, and further specifically in particular 15% from the average moisture content of all the pads in the stack, even when the determination of the moisture content of the pads in the stack takes place four weeks after the moisturization, stacking and arrangement in the packaging container. The arrangement of the pads distinguishes itself from known arrangements, as mentioned, by a substantial but not excessive moisture content in that the desired moisture distribution is retained: the result is not, as with some known pads, an extreme enrichment of the fluid at the bottom of the packaging container and associated therewith a downright soaking of the lowest pad. Considerable importance is attached to the formation of the fiber structure of air-laid staple fibers and the individual moistening of the pads, this structure being responsible for retaining the moisture content in the desired range even four weeks after being moisturized.

The pads have a basis weight of 40-350 g/m$^2$, specifically of 60-250 g/m$^2$, in particular of 100-200 g/m$^2$ and, furthermore, in particular of 100-140 g/m$^2$.

The pads have, in addition, a thickness of 0.6-4.0 mm, specifically of 0.8-3.5 mm, more specifically of 1.0-3.00 mm, and further in particular of 1.2-2.5 mm, measured at a test pressure of 0.5 kPa.

The pads show a good moisture retention capability, that is to say that under load (which is the case when using the pad, for example, for rubbing the skin) the pad dispenses fluid adequately but moderately. Moisture retention capability is determined in accordance with the following "centrifuge-method": moistened pads are laid out on the drum wall of the centrifuge (model 5942 SO with an acceleration of a=276 g, where g=9.81 m/s$^2$) individually without overlapping. A centrifugation stage follows for four minutes at 250 rpm. From the difference in the fluid discharged in the centrifugation stage (as weight determined from the difference between the initial weight of the moistened pad determined before the centrifuge stage and the weight of the pad after centrifuging) and the weight of the fluid employed, a conclusion can be formed about the fluid remaining in the pad. The moisture retention capability is expressed in percent of the weight of fluid remaining in the pad with respect to the weight of the fluid employed. The absorbent pads have a moisture retention capability of at least 80%, preferably of least 83%, in particular of at least 85%, and of a maximum of 98%, preferably of a maximum of 95%, and specifically of at most 93%.

Staple fibers with a length of 3 to 60 mm have proven their worth for the production of the pads and the formation of the stack arrangement. Fibers limited in their length are considered staple fibers which may be chemical fibers, industrially produced fibers from natural or synthetic polymers and natural fibers. If chemical fibers are used in addition as staple fibers, they may be 15 to 40 mm long, and specifically 15 to 25 mm. The length of natural staple fibers, such as cotton fibers, is 9-15 mm, and, specifically, approximately 12 mm.

The previously mentioned chemical fibers as staple fibers can be microstaple fibers or be microstaple fibers. The term "microstaple" fibers means here that the fibers have a size of <1 dtex.

Microstaple fibers can be polyester (PES) fibers or rayon fibers (rayon fibers consist of natural cellulose molecules but which are synthetically processed to create fibers).

When microstaple fibers are used, they are hydrophilated on their surface in order to provide good fluid absorption capability.

The percentage of microstaple fibers amounts to 15-85% by weight, specifically 15 to 65% by weight, and further specifically 20 to 30% by weight within the fiber structure. Quoting the percentage by weight of the fibers is always understood to be relative to the unmoistened fiber structure.

As already mentioned, in one aspect up to 72% by weight, specifically 15 to 65% by weight, and further in particular 50 to 65% by weight of cotton fibers are contained in the fiber structure. These fibers can be cotton combings.

In a further aspect it is proposed that the fiber structure of the pads additionally includes heat-meltable binding fibers, likewise as staple fibers, specifically in a percentage by weight of 10 to 20%, specifically from 10 to 18%, and further specifically of 10 to 15%.

In the case of these binding fibers, the fibers can be multi-component fibers, specifically bi-component fibers, having in particular a sheath/core arrangement of the two components.

These multi-component fibers have a fiber size of 1.3-10 dtex, in particular of 1.3-3.0 dtex and a fiber length of 3-60 mm, in particular of 40-60 mm. In the case of bicomponent fibers which are to be used preferably they may be polyester (PES)/copolyester (CO-PES) bicomponent fibers.

In any case, in one aspect the melting point of the heat-meltable binding fibers or of the low-melting point components of the multi-component fibers as binding fibers is lower than the melting point of staple fibers or microstaple fibers used in addition.

Another composition of the fiber structure of a pad to create the stack arrangement includes up to 20-30% by weight microstaple fibers, up to 9-17% by weight binding fibers and up to 58-66% by weight cotton fibers.

The pads, which are fiber non-woven structures, can be water-jet needled for compaction which can specifically involve only superficial areas of the fiber structure or can also mean needlepunching the pads. The pads can also be thermally compacted. The compacting steps of the water-jet needling or thermal compacting can be present individually or preferably in combination.

In addition, in a further aspect the pads can be embossed, where "embossed" is understood to mean depressions with a depth of more than 0.2 mm, specifically of at least 0.25 mm, and in particular of at least 0.35 mm, depressions therefore which have a greater depth than the fine rib structure familiar to one skilled in the art produced by water-jet needling and with a depth of only 0.05-0.2 mm. An already pre-compacted non-woven material, if necessary under the effects of heat, can be given an embossed structure in particular with the help of a stamping calendar. Embossed surfaces can also be created by means of water-jet needling, specifically with the application of screening drum technology.

In a further aspect, embossing of a pad can be designed in the form of an embossed structure such that this embossed structure is surrounded completely by a second area (radially outward). This second area can be unembossed or have an additional embossed structure different from this first embossed structure.

In a further aspect, at least one side of the pad can be configured with a rough surface by sintering on a particulate abrasive. The abrasive is not melted on, rather the particles are bonded to the pad and if necessary to each other by the sintering process, largely retaining the particle shape forming the rough surface structure but rounding off the surface of the particles while only the surface of the particles is superficially or surface fused. The melt adhesive powder which is to be used includes polyethylenes, such as LDPE with a melting range of 100-114° C. and/or polyamide, such as copolyamide with a melting range of 110-127° C. and/or polyester, such as copolyester with a melting range of 105-115° C. The powder has a grain of 1-500 μm, and specifically of 50-200 μm. The abrasive is applied with a basis weight of 5-50 g/m$^2$, specifically of 10-40 m$^2$, and further in particular of 7-25 m$^2$.

For moistening, aqueous solutions, oil-in-water emulsions, water-in-oil emulsions, alcohol solutions or solutions on a tenside base can be applied to the pads as an impregnating fluid.

The impregnating fluids can comprise additives from one or more of the groups of plant extracts, oils, in particular plant oils, vitamins, vitamin derivatives, antimicrobial substances, antioxidants, detergent substances, tensides, aromatics, emollients, moisturizers, emulgators, stabilizers, thickeners, dyes or preservatives. The additives can be micro-encapsulated.

The pads may be exposed to an impregnating fluid having a viscosity of <800 mPa.

In a further aspect of the invention, the arrangement includes two stacks, wherein pads in different stacks overlap only in a partial area such that a pad from the one stack protrudes between two pads of the other stack.

The arrangement can include at least 10 pads and, at the most 65 pads, specifically at the most 40 pads, and further, in particularly, at the most 24 pads in one stack.

The largely evaporation-inhibiting closable packaging container is intended to surround the enclosed moist pads essentially air-tightly and provided closeable, in particular, reclosable access to moist pads.

The packaging container is designed in such a way that it is suitable for holding at least two stacks, in particular, of two stacks whose pads overlap alternately. Such a packaging container to accept at least two stacks of pads, in which the pads in different stacks overlap in only a partial area such that a pad from the one stack projects between two pads in the other stack into the partial area, is designed in such a way that the packaging container has an external shape which matches the partial overlapping of the moistened pads but diverges from the basic shape of the pads. An opening for removal in the manual access area which is specifically recloseable is provided above the overlap area of the pads. Oval pads are arranged in the two stacks so that the packaging container has an exterior shape approximating an octagon.

When speaking about the pads in an upper and lower fourth, or in the outer fourths of a stack, this does not necessarily require that the number of pads in a stack has to be a multiple of 4. If, for example, 19 pads are contained in an arrangement, the outer fourths are determined by dividing the number of pads by 4 which gives the result "4—remainder 3." To determine the moisture content, 4 pads are assigned to the outer (upper or lower) fourth of the stack and the moisture content of these 4 pads is determined individually and from this the average is determined and the difference of the averages is calculated. In order to compare this difference with the average moisture content of all the pads, the moisture content of the remaining pads (in the present example the moisture content of the 19−8=11 middle pads) must be determined, which will be described hereinafter.

A method is disclosed for producing an arrangement of a plurality of moistened cosmetic pads in which an air-layered fiber web is formed, the pads are formed from this fiber web and the pads are then individually moistened.

The pads are may be exposed to the effects of pressure when still in their individualized state immediately after or during the moistening so that the pads are compressed in order to equalize the distribution of fluid in the pad.

A pressure exerted on the pads can be 0.5 mbar to 10 bar.

In a further aspect, the potential exists for furthering the speed and the consistency of the moistening of the pads with the assistance of vacuum.

If cosmetic pads are designated as cotton pads, this is understood to mean generally absorbent pad-shaped fiber non-woven articles whose fiber content is made up of cotton fibers. It should be expressly pointed out that such pad-shaped fiber non-woven articles can be designated as cotton pads whose fiber content is formed from different cellulose fibers, or which besides cellulose fibers comprise synthetic fibers such as thermoplastic fibers, for example, polyester, polyamide, polyacrylate, polyolefins, polyurethane as well as multi-component fibers, in particular as bi-component fibers and preferably as microfibers with a fiber size of <1 dtex, and, in particular, specifically microstaple fibers with a length of at least 7 mm.

The pads may have a circular shape, or an oval shape. Rectangular or square shapes are also conceivable. The circular pads may have a diameter of 5-7 cm. Oval pads comprise an area may with the dimensions of (60-80 mm)×(80-100 mm) for example. Square pads may have a side length between 60-80 mm, specifically of 75 mm. Rectangular pads have an area with dimensions of (70-100 mm)×(90 mm-120 mm), specifically (85 mm-95 mm)×(105 mm-115 mm).

An additional independent aspect is an arrangement of a multiplicity of moistened cosmetic pads on a non-woven basis which are housed stacked in a largely evaporation-inhibiting closable packaging container, where the pads show an average moisture content of at least 200% and a maximum of 500% weight by content of their dry weight, and the pads include a fiber structure of staple fibers, have a thickness of 0.6-4.0 mm and are individually moistened.

These pads have on average a moisture content of at least 250%, specifically of at least 300%, more specifically of at least 320% and, even more specifically, of a maximum of 450%, or a maximum of 400% of their dry weight.

These pads have a thickness of 0.8-3.5 mm, specifically of 1.00-3.00 mm, and further in particular of 1.2-2.5 mm.

These pads have one or more of the additional previously mentioned features, in particular regarding the fiber composition (type of fibers; percentual composition), the length of the fibers, the compacting measures (water-jet needling, thermal compacting, embossing), the arrangement in stacks, the exposure to impregnating fluid and the difference in the average moisture content in the pads located in the upper and in the lower fourths of the stack.

One composition of cosmetic pads on a non-woven base includes a fiber structure of staple fibers. The composition of these staple fibers is provided by 25% by weight microfibers of polyester, specifically of a length of 18 mm and a fiber size of 0.9 dtex, and 13% by weight bicomponent fibers as binder fibers, polyester (PBS)/copolyester (CO-PES) bicomponent fibers, with a length of 51 mm and a fiber size of 2.2 dtex and 62% cotton combings which have a length of about 12 mm as natural fibers.

The aforementioned staple fibers are airlaid as a dry fiber mixture to form an endless non-woven web. From this non-woven web pads are then formed of any shape, in particular round or oval, in particular embossed. These pads are moistened individually after being formed from the fiber web, treated with a previously apportioned amount of fluid and then arranged in a stack in a packaging container.

The pads formed from the non-woven web can, for example, be stored in stacks and taken in this form to a device for individual moistening of the pads. For example, it is conceivable that by means of a suction gripping device 2 shown schematically in FIG. 1 a single pad is removed from the stacked arrangement 4 and taken to a moistening station 6. In the moistening station 6, the pad is located in a tub-shaped holder 8 adapted to the shape of the pad into which a specific previously measured amount of fluid is supplied through a metering device, not shown. A precisely metered amount of fluid is absorbed by or introduced into the pad located in the moistening station. The moistening of the pad takes place under the effects of pressure, not shown. Pressure from 0.5 mbar to 10 bar may be used. In the same way, the possibility also exists of using vacuum. After moistening, the pad is picked up by the suction gripping device 2 and removed from the moistening station 6 and then transferred to a storage device 10 which deposits one pad after the other to form a stack-like arrangement 12. The deposition and the formation of the stack-like arrangement 12 takes place directly in an adjacent evaporation-inhibiting closeable packaging container 14.

It would also be conceivable that the formation of the stack takes place outside of such a packaging container and the thus formed stack is then placed as a whole into a packaging container.

A number of 20 pads of the previously described type were formed from an airlaid fiber non-woven with a base weight of 115 g/m$^2$ and a thickness of approximately 1.3 mm (measured at a test pressure of 0.5 kPa). The pads have an oval shape with a diameter of 70 mm×90 mm. The dry weight was determined by individually weighing each of the 20 pads and established precisely in grams to two decimal places.

To determine the dry weight, the pad is dried to a dry consistency at 100-150° C. and weighed after cooling to room temperature (cooling in a desiccator). Three ml of an impregnating fluid (Emulgade CM from Cognis Germany GmbH, Düsseldorf) is introduced into the pads having the following composition:

| | |
|---|---|
| I. Cetearyl isononanoate (and) ceteareth-20 (and) ceteraryl alcohol 9 (and) glyceryl stearate (and) glycerin (and) cetereath-12 (and) cetyl palmitate | 15.00% by weight |

-continued

| | |
|---|---|
| Water | 83.50% by weight |
| II. Coceth-7 (and) PPG-1-PEG laurel glycol ether (and) PEG-40 hydrogenated castor oil | 0.30% by weight |
| Jade perfume oil (from Symrise) | 0.30% by weight |
| III. Phenoxyethanol (and) benzoic acid (and) dehydroacetic acid | 0.60% by weight |
| IV. KOH (20%) | approx. 0.3% by weight |

pH = 5.5

Afterwards the weight of the moistened pads was again determined by individual weighing. By generating the calculated difference of the weights of the moist pads and the dry pads, the moisture content in grams was determined and from this the moisture content was computed in percent relative to the dry weight.

The quantities thus determined can be seen from the table below. They were obtained essentially immediately after moistening and formation of the stack. Afterwards the stack-shaped arrangement in the form of two stacks with alternately overlapping pads was created and heat-sealed in a moisture-proof, closable freezer bag to simulate a packaging container and stored at room temperature. After four weeks the weight was again established for each individual pad in the arrangement and the moisture content determined by differential formation with the initially determined weights of the dry pads and again given related percentually to the dry weight.

The values for this second weighing were analyzed four weeks after the moisturization and stack formation, as can be seen from the table. The average value for the moisture content of the upper and lower quarters, or of the outer quarters respectively, of the stack was determined. These are the upper 5 pads (pad number 1 to 5) and the lower 5 pads (pads number 16 to 20). The difference in the average value of the moisture content of the pads of the upper quarter and the lower quarter and the difference is compared with the average moisture content of all pads and given as a percentage thereof.

TABLE

| | | Weighing immediately after moistening | | | | | |
|---|---|---|---|---|---|---|---|
| Pad No. | Pad dry | Pad with impregnating fluid | Moisture content (g) | Moisture content (%) | Partial total | Average | Difference between 1st and 4th fourth |
| 1 | 0.65 | 3.66 | 3.01 | 463.08 | | | |
| 2 | 0.58 | 3.44 | 2.86 | 493.10 | | | |
| 3 | 0.62 | 3.74 | 3.12 | 503.23 | | | |
| 4 | 0.59 | 3.49 | 2.90 | 491.53 | | | |
| 5 | 0.58 | 3.58 | 3.00 | 517.24 | 2468.17 | 493.63 | |
| 6 | 0.60 | 3.61 | 3.01 | 501.67 | | | |
| 7 | 0.61 | 3.68 | 3.07 | 503.28 | | | |
| 8 | 0.56 | 3.36 | 2.80 | 500.00 | | | |
| 9 | 0.63 | 3.63 | 3.00 | 476.19 | | | |
| 10 | 0.60 | 3.44 | 2.84 | 473.33 | 2454.47 | 490.89 | |
| 11 | 0.60 | 3.59 | 2.99 | 498.33 | | | |
| 12 | 0.61 | 3.35 | 2.74 | 449.18 | | | |
| 13 | 0.60 | 3.47 | 2.87 | 478.33 | | | |
| 14 | 0.56 | 3.54 | 2.98 | 532.14 | | | |
| 15 | 0.57 | 3.58 | 3.01 | 528.07 | 2486.06 | 497.21 | |
| 16 | 0.60 | 3.59 | 2.99 | 498.33 | | | |
| 17 | 0.60 | 3.45 | 2.85 | 475.00 | | | |
| 18 | 0.59 | 3.29 | 2.70 | 457.63 | | | |
| 19 | 0.61 | 3.68 | 3.07 | 503.28 | | | |
| 20 | 0.58 | 3.48 | 2.90 | 500.00 | 2434.24 | 486.85 | |
| Average | 0.60 | 3.53 | 2.94 | 492.15 | | | 6.79 |
| s | 0.02 | 0.12 | | | | | referred to total average in % |
| min | 0.56 | 3.29 | | | | | |
| max | 0.65 | 3.74 | | | | | 1.38 |

TABLE-continued

| Pad No. | Pad dry | Pad with impregnating fluid | Moisture content (g) | Moisture content related to dry weight (%) | Partial total | Average | Difference between 1st and 4th fourth |
|---|---|---|---|---|---|---|---|
| 1 | 0.65 | 3.30 | 2.65 | 407.69 | | | |
| 2 | 0.58 | 3.08 | 2.50 | 431.03 | | | |
| 3 | 0.62 | 3.34 | 2.72 | | | | |
| 4 | 0.59 | 3.19 | 2.60 | | | | |
| 5 | 0.58 | 3.24 | 2.66 | | 2176.74 | 435.35 | |
| 6 | 0.60 | 3.32. | 2.72 | | | | |
| 7 | 0.61 | 3.44 | 2.83 | | | | |
| 8 | 0.56 | 3.10 | 2.54 | | | | |
| 9 | 0.63 | 3.42 | 2.79 | | | | |
| 10 | 0.60 | 3.20 | 2.60 | | 2247.03 | 449.41 | |
| 11 | 0.60 | 3.38 | 2.78 | | | | |
| 12 | 0.61 | 3.23 | 2.62 | | | | |
| 13 | 0.60 | 3.37 | 2.77 | | | | |
| 14 | 0.56 | 3.34. | 2.78 | | | | |
| 15 | 0.57 | 3.40 | 2.83 | | 2347.43 | 469.49 | |
| 16 | 0.60 | 3.50 | 2.09 | | | | |
| 17 | 0.60 | 3.41 | 2.81 | | | | |
| 18 | 0.59 | 3.27 | 2.68 | | | | |
| 19 | 0.61 | 3.57 | 2.96 | | | | |
| 20 | 0.58 | 3.43 | 2.85 | 491.38 | 2382.53 | 476.51 | |
| Average | 0.60 | 3.33 | 2.73 | 457.69 | | | 41.16 |
| s | 0.02 | 0.13 | 0.12 | 24.36 | | | referenced to total average in % |
| min | 0.56 | 3.08 | 2.50 | 407.69 | | | |
| max | 0.65 | 3.57 | 2.96 | 496.49 | | | 8.99 |

What is claimed is:

1. An arrangement of a plurality of moistened cosmetic pads which are stacked in a largely evaporative-inhibiting closeable packaging container for dispensing to the end user, wherein the pads on average have a moisture content of between 300% and 500% of their dry weight, characterized in that the arrangement comprises between 10 and 65 individually moistened pads and the moistened pads have a fiber structure consisting of airlaid staple fibers that comprise synthetic microstaple fibers in an amount between 15% to 65% by weight and cotton fibers between 15% to 72% by weight and are individually moistened and have a consistent moisture content within the arrangement such that the difference in the average moisture content of the pads located in the upper and in the lower fourths of the stack is at most 30% of the average moisture content of all pads in the stack.

2. The arrangement of claim 1, wherein the difference in the average moisture content of the pads located in the upper and in the lower fourths of the stack is at most 25%, of the average moisture content of all pads in the stack.

3. The arrangement of claim 1, wherein the pads on average have a moisture content of at least 320%, and of at most 450% of their dry weight.

4. The arrangement of claim 1, wherein the pads have a basis weight of 40-350 g/m$^2$.

5. The arrangement of claim 1, wherein the pads have a thickness of 0.6-4.0 mm.

6. The arrangement of claim 1, characterized by staple fibers with a length of 3-60 mm.

7. The arrangement of claim 1, wherein the synthetic microstaple fibers are one of polyester (PES) fibers and rayon fibers.

8. The arrangement of claim 1, wherein the microstaple fibers are hydrophilated on their surface.

9. The arrangement of claim 1, wherein the cotton fibers are cotton combings.

10. The arrangement of claim 1, wherein the pads additionally include heat-meltable binding fibers as staple fibers in a percentage by weight of 10-20%.

11. The arrangement of claim 10, wherein the binding fibers are multicomponent fibers, specifically bi-component fibers.

12. The arrangement of claim 10, wherein the binding fibers have a fiber size of 1.3-10 dtex.

13. The arrangement of claim 11, wherein the multi-component fibers are polyester (PES)/copolyester (CO-PES) bi-component fibers.

14. The arrangement of claim 11 wherein the binding fibers have a fiber size of 1.3-10 dtex.

15. The arrangement of claim 11 wherein the binding fibers have a fiber size of 1.3-10 dtex wherein the binding fibers have a fiber length of 3-60 mm.

16. The arrangement of claim 11 wherein the binding fibers have a fiber length of specifically of 40-60 mm.

17. The arrangement of claim 1, wherein the pads comprise up to 20-30% by weight microstaple fibers, up to 9-17% by weight binding fibers and up to 58-66% by weight cotton fibers.

18. The arrangement of claim 1, wherein the pads are water-jet needled.

19. The arrangement of claim 1, wherein the pads are thermo-compacted.

20. The arrangement of claim 1, wherein the pads are exposed to one of aqueous solutions, oil-in-water emulsions, water-in-oil emulsions, alcoholic solutions and solutions on a tenside base as an impregnating fluid.

21. The arrangement of claim 20, wherein the impregnating fluids comprise additives from one or more of the groups of plant extracts, oils, in particular plant oils, vitamins, vitamin derivatives, antimicrobial substances, antioxidants, detergent substances, tensides, aromatics, emollients, moisturizers, emulgators, stabilizers, thickeners, dyes and preservatives.

22. The arrangement of claim 1, wherein the pads are exposed to impregnating fluid with a viscosity of less than 800 mPa.

23. The arrangement of claim 1, comprising two different stacks, the pads from different stacks overlapping in only a partial area such that one pad of the one stack projects between two pads of the other stack.

24. The arrangement of claim 1, wherein the difference in the average moisture content of the pads located in the upper and in the lower fourths of the stack is at most 20% of the average moisture content of all pads in the stack.

25. The arrangement of claim 1, wherein the difference in the average moisture content of the pads located in the upper and in the lower fourths of the stack is at most 15% of the average moisture content of all pads in the stack.

26. The arrangement of claim 1, wherein the pads on average have a moisture content of at least 320% of their dry weight.

27. The arrangement of claim 1, wherein the pads on average have a moisture content of at most 400% of their dry weight.

28. The arrangement of claim 1 wherein the pads have a basis weight of 60-250 g/m$^2$.

29. The arrangement of claim 1 wherein the pads have a basis weight of specifically of 100-200 g/m$^2$.

30. The arrangement of claim 1 wherein the pads have a basis weight of 100-140 g/m$^2$.

31. The arrangement of claim 1 wherein the pads have a thickness of 0.8-3.5 mm.

32. The arrangement of claim 1 wherein the pads have a thickness, specifically of 1.0-3.0 mm.

33. The arrangement of claim 1 wherein the pads have a thickness of 1.2-2.5 mm.

34. The arrangement from of claim 1 wherein the pads are formed of staple fibers with a length of 15-40 mm.

35. The arrangement from of claim 1 wherein the pads are formed of staple fibers with a length of 15-25 mm.

36. The arrangement of claim 1 wherein the percentage of microstaple fibers amounts to 15-65% by weight.

37. The arrangement of claim 1 wherein the percentage of synthetic microstaple fibers amounts to 20-30% by weight.

38. The arrangement of claim 1 wherein the pads additionally include cotton fibers up to 50-65% by weight.

39. The arrangement of claim 1 wherein the pads include additionally heat-meltable binding fibers as staple fibers in a percentage by weight of 10-18%.

40. The arrangement of claim 1 wherein the pads include additionally heat-meltable binding fibers as staple fibers in a percentage by weight of 10-15%.

41. The arrangement of claim 1 comprising between at least 10 pads at most 40 pads in one stack.

42. The arrangement of claim 1 comprising between at least 10 pads and at most 24 pads in one stack.

43. An arrangement of a plurality of moistened cosmetic pads which are stacked in a largely evaporative-inhibiting closeable packaging container for dispensing to the end user, wherein the pads on average have a moisture content of at least 200% of their dry weight, characterized in that the moistened pads each have a fiber structure of staple fibers and are individually moistened and have a consistent moisture content within the arrangement such that the difference in the average moisture content of the pads located in the upper and in the lower fourths of the stack is at most 30% of the average moisture content of all pads in the stack, wherein the pads additionally include heat-meltable, multi-component binding fibers composed of polyester (PES)/copolyester (CO-PES) bi-component fibers as staple fibers in a percentage by weight of 10-20% wherein the melting point of the low melting component of the multi-component fibers is lower than the melting point of the microstaple fibers.

44. A method for producing the arrangement of a plurality of moistened cosmetic pads as defined in claim 1, the method comprising the steps of:

creating an air laid fiber web of staple fibers wherein the staple fibers comprise synthetic microstaple fibers present in an amount between 15 to 65% by weight and cotton fibers present in an amount between 15 to 72% by weight;

forming the pads from the fiber web, the formed pads having a dry weight;

individually moistening the pads, wherein the moistening step produces individually moistened pads each having, on average, a moisture content of 300% to 500% of the dry weight of the pads;

assigning the individually moistened pads to a stack; and then positioning the resulting stack in a largely evaporative-inhibiting closable packaging container.

45. The method of claim 44 further comprising the steps of:

wherein each of the pads is compressed after or during moistening but before the assigning step in order to equalize the distribution of moisture in the respective pads.

* * * * *